United States Patent [19]

Weiss et al.

[11] Patent Number: 4,726,698

[45] Date of Patent: Feb. 23, 1988

[54] DEVICE FOR PRESSING A STACK OF SHEETS AGAINST A ROLLER DRIVE OF A PAPERSHEET SEPARATOR

[75] Inventors: Udo I. Weiss; Friedhelm Eckhardt, both of Siegen, Fed. Rep. of Germany

[73] Assignee: U.S. Philips Corporation, New York, N.Y.

[21] Appl. No.: 935,147

[22] Filed: Nov. 25, 1986

Related U.S. Application Data

[63] Continuation of Ser. No. 757,961, Jul. 23, 1985, abandoned.

[30] Foreign Application Priority Data

Jul. 26, 1984 [DE] Fed. Rep. of Germany ..... 3427514

[51] Int. Cl.[4] ..... B41J 13/10

[52] U.S. Cl. ..... 400/629; 271/127; 271/160; 271/171

[58] Field of Search ..... 400/624, 625, 626, 627, 400/628, 629, 633.2; 271/30.1, 126, 127, 160, 171

[56] References Cited

U.S. PATENT DOCUMENTS

| | | | |
|---|---|---|---|
| 1,203,657 | 11/1916 | Sheckler | 400/629 |
| 1,209,126 | 12/1916 | Corcoran | 400/633.2 |
| 2,887,208 | 5/1959 | Cross | 400/629 |
| 4,394,009 | 7/1983 | Bergman et al. | 271/126 X |

FOREIGN PATENT DOCUMENTS

| | | | |
|---|---|---|---|
| 84736 | 6/1980 | Japan | 271/160 |
| 113631 | 9/1981 | Japan | 271/126 |
| 145041 | 11/1981 | Japan | 271/160 |

*Primary Examiner*—Charles A. Pearson
*Attorney, Agent, or Firm*—Robert T. Mayer

[57] ABSTRACT

A device for pressing a stack (5) of sheets against a roller drive (2,4) of a papersheet separator, said device compromising a pivotable pressure plate (11) which is biased against the roller drive (2,4) by means of an adjustable leaf spring (12) in order to vary the pressure force. In this way a pressure force is obtained which suits paper sheets of different kinds. The device may be applied for example in printers and copiers.

9 Claims, 3 Drawing Figures

DEVICE FOR PRESSING A STACK OF SHEETS AGAINST A ROLLER DRIVE OF A PAPERSHEET SEPARATOR

This is a continuation of application Ser. No. 757,961, filed July 23, 1985, now abandoned.

The invention relates to a device for pressing a stack of sheets against a roller drive of a paper sheet separator. A pressure plate loaded by a compression spring and pivotably journalled at one side is mounted in a cassette and serves as a carrier for the stack of sheets.

Such a device, which is required more particularly for printers, copiers or the like, is described in U.S. Pat. No. 4,089,402. In this case, the compression spring is constituted by a lever arm, which is pressed by means of spring force against the pressure plate. In such a device, difficulties are met when greatly different kinds of paper should be processed. This is the case, for example, if sheets of different paper thickness or having different formats, especially also sets of forms or envelopes, should be used.

The invention has for its object to provide a device of the kind mentioned in the opening paragraph which permits feeding, without disturbance, kinds of sheets of different paper strengths and formats and also sets of forms and envelopes.

According to the invention, this is achieved in that the pressure force of the pressure plate is adjustable.

A particularly advantageous embodiment of the invention is characterized in that the compression spring is secured on a carriage which is displaceable in a direction perpendicular to the shaft axis of a pivot bearing of the pressure plate in such a manner that by the displacement of the carriage the effective lever arm between the pivot bearing and the point of application of the spring is varied. Advantageously, by the displacement of the carriage, the pressure force of the spring may also be varied.

For adaption to sets of forms and papers having over their widths different thicknesses, it is appropriate to use two or more pressure plates, at least one of which is provided with a device for varying the pressure force and is journalled so as to be laterally displaceable.

It is advantageous to guide the carriage in or along a carrier plate underlying the pressure plate. For journalling the pressure plate, it is appropriate to bend the carrier plate at least at the area of the pivot points of the pressure plate into the form of a U and to provide it with bores for receiving a bearing.

In order that the invention may be readily carried into effect, it will now be described more fully, by way of example, with reference to the accompanying drawing. For the sake of clarity, all the parts not essential for the illustration, such as sidewalls for the stack of sheets, driving mechanisms for driving the rollers and their connection to a driving motor, as well as the journalling and the construction of the complete cassette, are not shown.

Figure 1:
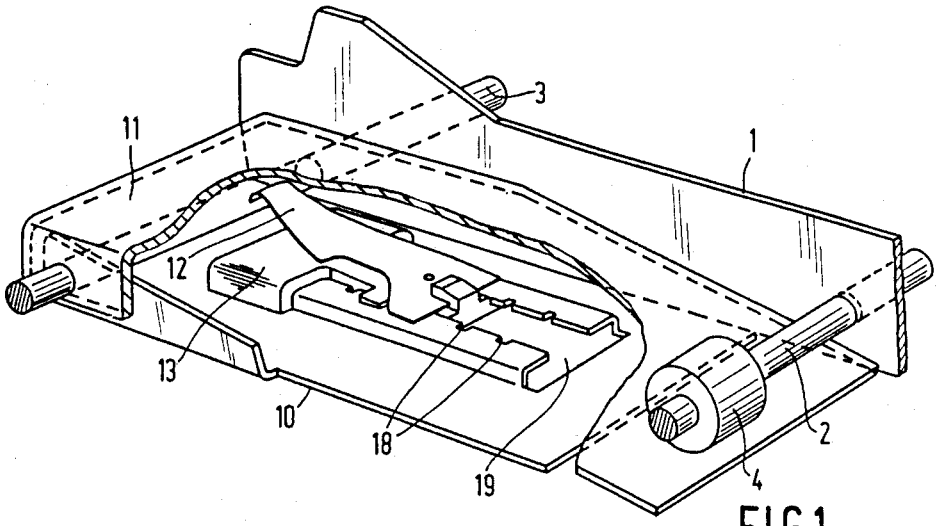
FIG. 1 shows in a perspective view, partly in sectional view, a pressure device for receiving a stack of sheets.

A cassette-shaped container has in its sidewall 1 bores for receiving the shafts 2 and 3. The shaft 2, which is rotated by a drive (not shown), carries a roller 4, which turns each time the upper sheet of a stack of sheets 5 is pulled along the paper guide 6. The sidewall 7 is secured to the bottom plate 8 at a fixed angle. A carrier plate 10 and a pressure plate 11 are displaceably journalled on the shaft 3 with the use of the bearings 9. The bearings 9 are formed by bearing nipples interspersed so as to be self-retaining and made, for example, of synthetic material. The carrier plate 10 and the pressure plate 11 are pivotable with respect to each other about the bearings 9 independently of the shaft 2. There is arranged between the parts 10, 11 a pre-stressed leaf spring 12, which in turn is secured to a carriage 13 and engages with the free end 14 a rib 15 and hence the pressure plate 11. When the carriage 13 is tilted about the edge 16 by pressing on the part 17 against the force of the leaf spring 12, the projections 22 of the carriage 13 can be removed from the recesses 18 and the carriage 13 can then be moved along the slotshaped guide 19.

It is apparent that by the movement of the carriage 13 away from the shaft 3, the effective lever arm between the shaft and the free end 14 of the leaf spring 12 is increased. Thus, an increase of the pressure force is obtained by which the stack of sheets 5 is pressed against the roller 4.

Figure 2:
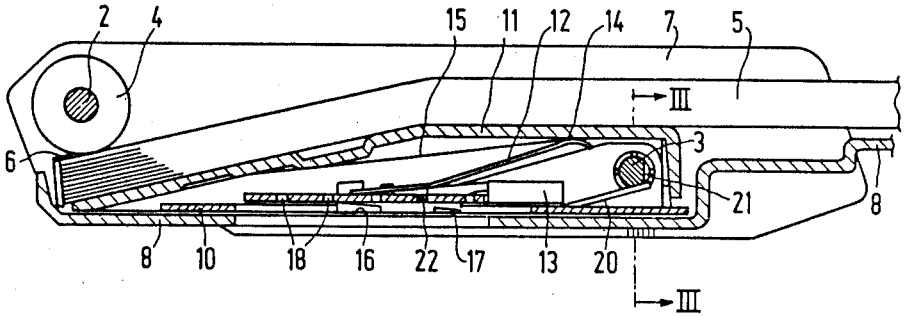
FIG. 2 shows in a side elevation, partly in sectional view, the components of the pressure device and its association with a stack of sheets and a driving roller for feeding individual sheets.
Figure 3:
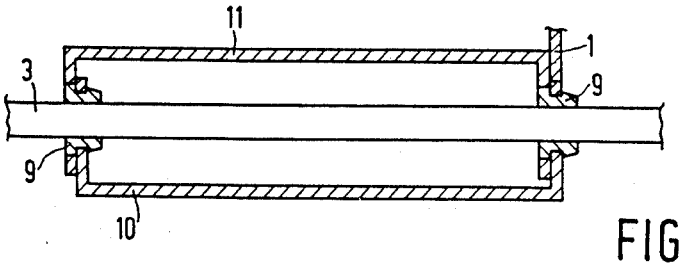
FIG. 3 shows a cross-section taken on the lines III—III.

A tongue-shaped part 20 is stamped out of the carrier plate 10 and is bent so that it is biased against the shaft 3. If the shaft 3 is rotated so (in the embodiment of FIG. 2 by about 90°) that the spring part 20 engages the flattened part 21 shown in FIG. 2, the carrier plate 10 with carriage 13 and pressure plate 11 can be moved along the shaft 3. Thus, the pressure plate 11 with the sidewall connected to the carrier plate 10 can be adjusted to the desired paper width. If the shaft 3 is moved back to the position shown, the carrier plate 10 is locked against displacement by the engagement of the part 20 with the shaft 3. The shaft 3 can be pivoted by means of a lever secured laterally to the shaft 3 at a fixed angle.

What is claimed is:

1. A device for pressing a stack of sheets against a roller drive of a paper sheet separator including a pressure plate pivotally journalled at one of its ends about a bearing shaft which defines a pivot axis, a single leaf spring arranged to apply a pressure force against said pressure plate at a location which establishes a lever arm extending from said pivot axis to said location, said pressure plate serving as a carrier of a stack of sheets, said carrier being capable of applying a pressure force to said stack, means for varying the pressure force of said carrier including a carriage means, said leaf spring being secured on said carriage means, said carriage means and said leaf springs being movable along a straight line path toward and away from said one end in a direction perpendicular to said pivot axis, said carriage means being movable along said straight line path to vary the length of said lever arm and the location on said pressure plate at which the pressure force is applied by said leaf spring, a carrier plate underlying said carrier, said carriage means being guided on said carrier plate, said carrier and said carrier plate being journalled on said bearing shaft, said bearing shaft having a section which has a round portion and a flat portion on its cross-sectional periphery and said carrier plate having a resilient member, said section of said bearing shaft and said resilient member providing a cooperating means operating to permit relatively easy motion of said carrier plate along said shaft when said shaft is turned so that said resilient member engages said flat portion and to inhibit such motion when said shaft is turned so that said resilient member engages said round portion.

2. A device as claimed in claim 1, wherein movement of said carriage means varies the pressure force applied by said carrier to said stack.

3. A device as claimed in claim 1, wherein said carrier plate is bent into the form of a U in the area of said pivot axis and is provided with bores for receiving bearings.

4. A device as claimed in claim 3, wherein bearing nipples connect said carrier and said carrier plate to each other.

5. A device as claimed in claim 4, wherein said bearing shaft passes through said bearing nipples.

6. A device as claimed in claim 1, wherein said resilient member is in the form of a tongue.

7. A device as claimed in claim 1, wherein said carrier plate has a slot shaped guide formed with several successive recesses and wherein said carriage means includes projections for cooperation with said recesses.

8. A device as claimed in claim 7, wherein said projections can be moved out of cooperation with said recesses against the force of said leaf spring.

9. A device as claimed in claim 8, wherein said leaf spring is arranged obliquely between said carriage means and said pressure plate.

* * * * *